US006047484A

United States Patent [19]

Bolland et al.

[11] Patent Number: 6,047,484

[45] Date of Patent: Apr. 11, 2000

[54] METHOD AND APPARATUS FOR EVAPORATING LIQUID FROM A PRODUCT

[76] Inventors: Karin Marie Bolland, 2515 S. Tacoma Way, Tacoma, Wash. 98409; Richard Elwood Magoon, 1917 Willow La. West, Tacoma, Wash. 98466

[21] Appl. No.: 09/114,054

[22] Filed: Jul. 10, 1998

[51] Int. Cl.[7] ..... F26B 11/18

[52] U.S. Cl. ..... 34/197; 34/418; 34/237

[58] Field of Search ..... 34/302, 305, 418, 34/522, 60, 93, 196, 197, 237; 165/46, 70, 904

[56] References Cited

U.S. PATENT DOCUMENTS

| | | | |
|---|---|---|---|
| 1,739,567 | 12/1929 | Anderson | 34/237 |
| 3,732,627 | 5/1973 | Wertheim | 34/337 |
| 4,249,317 | 2/1981 | Murdock | 34/93 |
| 4,440,861 | 4/1984 | McCarthy | 435/306 |
| 4,631,837 | 12/1986 | Magoon | 34/353 |
| 4,713,252 | 12/1987 | Ismail | 426/290 |
| 5,519,946 | 5/1996 | Renzi | 34/239 |
| 5,534,274 | 7/1996 | DeStefano | 426/66 |
| 5,584,127 | 12/1996 | Sutherland | 34/93 |
| 5,743,022 | 4/1998 | Hall Taylor | 34/68 |
| 5,893,410 | 4/1999 | Halbrook | 165/118 |
| 5,904,807 | 5/1999 | Ramm-Schmidt et al. | 159/43.1 |
| 5,915,811 | 7/1999 | DeVore et al. | 34/93 |

*Primary Examiner*—Pamela A. Wilson

[57] ABSTRACT

The present invention provides a method and apparatus to transfer heat between a flowable product, such as a sludge, slurry, extract, juice or other like product, and a heated or chilled liquid, said heat transfer taking place through a thin, infrared transparent film fixed at an incline to permit gravity flow of both product and heated or chilled liquid. Especially even heat distribution within said product results from mixing as said product flows down the inclined plane of the infrared transparent film.

4 Claims, 1 Drawing Sheet

METHOD AND APPARATUS FOR EVAPORATING LIQUID FROM A PRODUCT

BACKGROUND OF THE INVENTION

This invention relates to the efficient transfer of heat to or from flowable liquid, suspension or solution products, and particularly to the concentration of such products by means of evaporation of liquid.

An efficient means of drying products such as fruit pulps was described in U.S. Pat. No. 4,631,837 issued Dec. 30, 1986, in which an infrared transparent film is supported by the buoyant force of water. Said film is not attached to a structure, making it impossible to incline the patented apparatus. When used to concentrate liquids, the patented method and apparatus have several drawbacks that are corrected in the presently described invention. On the aforementioned, patented apparatus it is difficult to handle liquid products in volumes required for concentration, as pooling occurs that results in uneven concentration of the product. Pooling also contributes to uneven heat distribution in the product.

The present invention improves upon the method and apparatus described in the aforementioned patent in that it may be inclined variably to accommodate flowable products of various viscosities. Another improvement of the present invention consists of improved heat distribution throughout the product during the heat transfer process, due to agitation of product created by the gravity flow of said product down the inclined plane of the heat-transfer surface of the present apparatus, agitation of product not being practical on the aforementioned patented device. Thus, the present invention utilizes the same infrared heat transfer principle in a different apparatus from that of U.S. Pat. No. 4,631,837, said different apparatus providing more uniform heat distribution within and more efficient heat transfer to or from fluid products.

Another difference between the presently described method and apparatus and that of U.S. Pat. No. 4,631,837 is that the aforementioned patented method requires mechanical removal of product, whereas in the present invention product removal from the apparatus occurs due to gravity flow. Finally, very limited re-circulation of product is feasible on the aforementioned patented apparatus, whereas it is quite practical on the present invention, re-circulation of product being useful when concentrating liquid product.

SUMMARY OF THE INVENTION

The present invention provides a method and apparatus for efficient heat transfer to or from fluid products, while maintaining substantially uniform heat distribution within said fluid products, the heat transfer taking place via infrared heat transfer and conduction through an infrared transparent sheet held between the product and a temperature controlled liquid.

DETAILED DESCRIPTION OF THE INVENTION

In accordance with the present method, a heat transfer liquid is heated or chilled to some predetermined temperature. For example, if very rapid heat transfer is required, the temperature of the liquid is maintained as close as possible to the boiling or freezing point of that liquid as is possible without actually producing boiling or freezing. Therefore, at sea level, the temperature of water would be close to 100 degrees C. if heating the product is required, or to 0 degrees C. if chilling the product is required. A thin film of infrared transparent, impermeable, solid material, such as a polyester film, is positioned over and sealed at the sides to another solid, impermeable material, such as a stainless steel sheet. Said temperature controlled liquid is then flowed between the film of infrared transparent material and the solid material, such as stainless steel, such that the temperature controlled, liquid, heat transfer medium is in substantially uniform, intimate contact with the infrared transparent material. Fluid product to be temperature-modified (i.e. evaporated, blanched, heated, chilled, etc.) is flowed by gravity down the inclined plane of the polyester film. In addition to the heat transfer through the infrared transparent material that takes place between heat transfer liquid and product separated by said film, as was described in U.S. Pat. No. 4,631,837, the flow of product down the incline produces a mixing action within the product, which continually improves heat distribution within said product.

Figure 1:
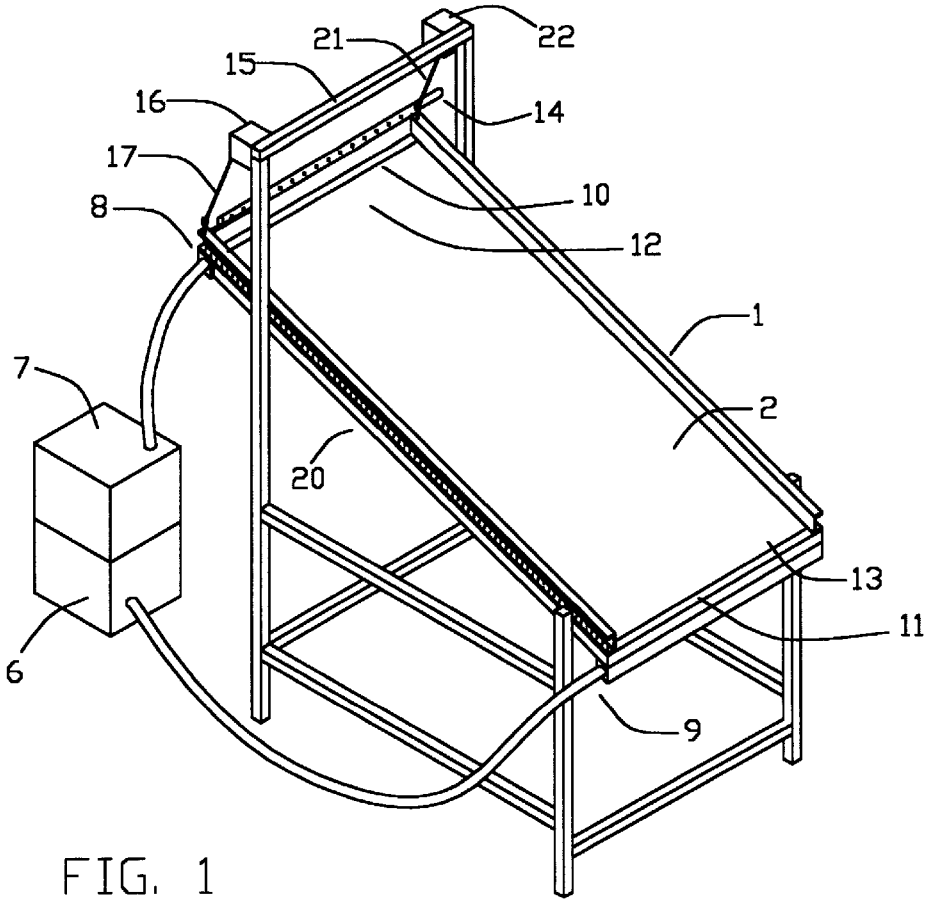
FIG. 1 is an isometric view of an embodiment of the present invention.
Figure 2:
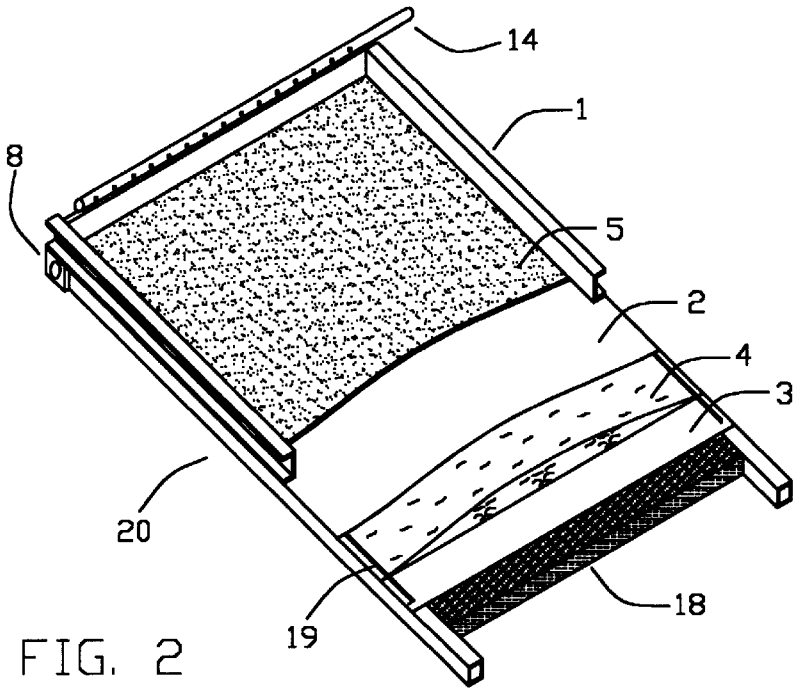
FIG. 2 is an isometric view of a portion of an embodiment of the present invention with portions cut away to facilitate illustration of the apparatus.

An embodiment of the present invention to carry out the method described above is shown in FIGS. 1 and 2. A structure 1 clamps a thin, flexible sheet of infrared transparent, solid, impermeable material 2, such as polyester film, to a first planar surface of a solid, nonporous, backing sheet 3, such as stainless steel. Said solid backing sheet 3 is in turn backed with an insulating material 18. A leak proof seal 19 is included between material 2 and sheet 3. Temperature control system 6 heats or chills liquid 4, which is then circulated by circulation system 7 to liquid inlet 8 of the apparatus. Liquid inlet 8 supplies liquid to liquid distribution box 10. Distribution box 10 supplies liquid 4 between material 2 and sheet 3. Liquid 4 flows by gravity from upper end 12 of the apparatus to lower end 13 of the apparatus. At lower end 13 liquid collector box 11 collects liquid 4. Liquid 4 flows out of collector box 11 via connector 9 and is returned to the temperature control system 6. The grouping composed of structure 1, infrared transparent, solid, impermeable material 2, solid backing sheet 3, insulation 18, leak proof seal 19, liquid inlet 8, liquid distribution box 10, connector 9, collector box 11, and product distribution means 14 comprise heat transfer assembly 20. Heat transfer assembly 20 is supported and inclined by structure 15 and cables 17 and 21. Winches 16 and 22 are used to alter the inclination of heat transfer assembly 20. Product 5 is applied to the outer surface of material 2 via product distribution means 14 at upper end 12 of the apparatus. Product 5 flows by gravity down material 2 to lower end 13 of the apparatus. Product 5 is collected at lower end 13 of the apparatus. Product 5 may be re-circulated to upper end 12 of the apparatus of FIG. 1, or, alternatively, product 5 may be delivered to another similar apparatus, not shown, or, alternatively, product 5 may be collected as a finished product, not shown.

The temperature range of heat transfer liquid 4 may be extended through the use of additives or fluids other than water, including but not limited to saline, glycol, and silicone solutions, oil, and the like. As infrared transparent, solid, impermeable material 2 is securely attached and sealed in the present invention, as opposed to the device described in U.S. Pat. No. 4,631,837, a wider range of heat transfer liquids may be safely used in the present invention than in said patented invention.

Managing air flow properly is important for efficiency in performing different types of heat transfer operations. The present invention readily lends itself to the attachment of air handling equipment, including forced air, controlled atmosphere, closed cycle, and the like. This makes the present invention especially appropriate for staged evaporation of a highly volatile substance, such as an alcohol, ketone, or such, at a relatively low temperature, followed by higher temperature evaporation of water from the product. This may be done in a closed loop system where, after evaporation of said volatile substance, said volatile is recovered in a condenser.

While an embodiment of the invention has been described and illustrated, it is clear that many changes can be made to the illustrated and described embodiment without exceeding the scope of the invention. For example, a variety of materials may be used for the infrared transparent, solid, impermeable material, depending upon the application. Also, while a single apparatus may provide adequate heat transfer for batch processing of some products, a modular apparatus made up of various heat transfer assemblies stacked in a tower may be required for continuous processing of other products. A further change might involve a means to mechanically move product down an inclined heat transfer assembly.

The embodiments of the invention in which an exclusive property or privilege is claimed are defined as follows:

1. An apparatus for evaporating liquid from a product to concentrate, said product comprising:

a structure;

a first sheet of infrared transparent, solid material fixedly attached to said structure and at an incline relative to horizontal, such that said product to be concentrated is flowed on a first surface of said first sheet;

a second sheet of solid material fixedly attached to said structure and held in close contact along two edges of said first sheet;

a flow of liquid maintained between said first and second sheets, such that said liquid intimately contacts a second surface of said first sheet;

a means of heating said liquid; and a means of circulating said heated liquid.

2. The apparatus of claim 1, further including a means of variably inclining said first and second sheets.

3. The apparatus of claim 1, further including a means to distribute said product along an upper edge of said first sheet, such that said product flows down said first sheet due to gravity.

4. A method of concentrating a product in which said product is flowed over said apparatus as presented in claim 1.

* * * * *